US005226022A

United States Patent [19]

Thinesen

[11] Patent Number: 5,226,022

[45] Date of Patent: Jul. 6, 1993

[54] MODE SELECTION OPTION WITH INSTRUCTIONAL MESSAGE FOR MULTIMODE ELECTRONIC TIMEPIECE

[75] Inventor: Tom Thinesen, Sunnyvale, Calif.

[73] Assignee: Timex Corporation, Middlebury, Conn.

[21] Appl. No.: 848,495

[22] Filed: Mar. 9, 1992

[51] Int. Cl.[5] ..... G04B 19/22

[52] U.S. Cl. ..... 368/22; 368/70; 368/73; 368/74; 368/187

[58] Field of Search ..... 368/185-190, 368/80, 73, 74, 70, 21-25, 82-84, 319-321, 15-19

[56] References Cited

U.S. PATENT DOCUMENTS

| | | | |
|---|---|---|---|
| 4,783,773 | 11/1988 | Houlihan | 368/108 |
| 4,887,249 | 12/1989 | Thinesen | 368/10 |
| 4,989,188 | 1/1991 | Thinesen | 368/70 |
| 5,140.563 | 8/1992 | Thinesen | 368/70 |

OTHER PUBLICATIONS

Timex Model No. M703 instruction manual.

*Primary Examiner*—Bernard Roskoski

*Attorney, Agent, or Firm*—William C. Crutcher

[57] ABSTRACT

In accordance with the present improvement of the present invention, in a multimode electronic timepiece, actuation of a first actuator while the timepiece is disposed in a "home" mode will cause to be displayed an alternate mode for a first predetermined period of time. If said first actuator is released prior to the elapse of said first predetermined period of time, the timepiece will be returned to said "home" mode. However, if the operator continues to actuate said first actuator beyond this first predetermined period of time, the program is adapted upon elapse of said first predetermined period of time, to immediately display on said timepiece display for a second predetermined period of time, a message indicating to the timepiece operator that continued actuation of said first actuator will cause the timepiece to be disposed into a predetermined alternate mode. If the operator releases said first actuator before the elapse of said second predetermined period of time, the timepiece will be returned to the "home" mode. Continued actuation of said first actuator beyond said second predetermined period of time, however, will cause the timepiece to be disposed in said predetermined alternate mode.

8 Claims, 3 Drawing Sheets

MODE SELECTION OPTION WITH INSTRUCTIONAL MESSAGE FOR MULTIMODE ELECTRONIC TIMEPIECE

The invention relates generally to multimode electronic timepieces. More particularly, this invention relates to an improved program adapted to allow a timepiece operator, while in a home mode, to temporarily view the status of an alternate mode, and then either return the timepiece to the home mode or dispose it into said alternate mode without cycling the timepiece through intervening modes.

Multimode, multifunction wristwatches (or wrist instruments) are known which include a display, a lamp for illuminating the display, a number of manually actuated switches and an integrated circuit programmed in a preselected sequence. Examples of such watches are seen in U.S. Pat. No. 4,788,733-Houlihan et al., U.S. Pat. No. 4,780,864-Houlihan and U.S. Pat. No. 4,283,784-Horan, all of the foregoing being assigned to the present assignee. In the Horan patent, a timepiece is provided with an integrated circuit, including a main random access memory (main RAM), a flag random access memory (flag RAM) and a programmed logic array (PLA), which are efficiently disposed in the timepiece such that a minimum amount of semiconductor chip space is used. The combination of these elements is adapted so as to provide for greater flexibility for operator selection of one of the plurality of timekeeping functions, or modes. In the foregoing Houlihan patents, which are merely exemplary of multimode electronic wrist instruments or multifunction wristwatches, one of the manual actuators may typically serve to repetitively cycle the instrument through a number of modes and operating states in each of which a different type of information is displayed. Such modes may include, in a multifunction watch, the time of day, chronograph, dual time zone countdown timer and so forth. By special preselected actuation of one of the actuators, the wristwatch may be converted into a computer, a speedometer, pulsometer or any other type of device, subject only to the imagination of the designer and programmer of the integrated circuit. While in any of these modes, another manual actuator may be employed to change the information being displayed in that mode's state, such as initiating the chronograph timing or setting the time-of-day, or performing a calculation.

Timepieces are known wherein actuation of a preselected actuator causes the timepiece to be temporarily disposed into a different mode, so that the timepiece operator may view temporarily the status of that mode, and then return to the mode in which the timepiece was originally operating. An example of such a timepiece is shown in U.S. Pat. No. 4,989,188, Thinesen, Program to Display an Alternate Mode in a Multimode Timepiece Jan. 29, 1991). This patent discloses an improved timepiece in which a preselected actuator is actuated to temporarily display the operating status of a mode other than that in which the timepiece is currently engaged so that the operator may avoid cycling the timepiece through intervening modes. The display of this alternate mode is only coincident with the actuation of the preselected actuator, however, for once the operator releases the actuator, the timepiece is automatically returned to the mode in which it was originally operating.

Timepieces are also known wherein mode selection is dependent upon the length of time for which a preselected actuator is depressed by the timepiece operator. Examples of such timepieces are shown in Model No. M703 and U.S. Pat. No. 4,887,249, Thinesen, Bicycle Watch-Dual Mode Circuit Dec. 12, 1989), which is assigned to the present assignee. Timex Model No. M703 discloses a digital timepiece which includes an ambient temperature-measuring device. The temperature measured by said device may be alternately displayed in Fahrenheit or Celsius degrees in the upper right-hand corner of the timepiece display in response to selective actuation of a preselected actuator by the timepiece operator. The selection of a particular temperature scale is dependent upon the length of time for which said preselected actuator is actuated. Thinesen discloses a dual-mode digital wristwatch which is adapted to operate in a "watch mode," displaying such information as time-of-day and date, but can also be adapted to operate in a "bike mode," serving as a computer to display such information as speed, distance and pedaling cadence. The timepiece operator may dispose the timepiece into one mode from the other mode if he continues to actuate a preselected actuator for greater than two seconds. Release of the actuator before the elapse of the two second period returns the timepiece display to the mode in which the timepiece was originally operating. The operator cannot however view the alternate mode before the elapse of the two second period.

It is desirable therefore to provide a timepiece such that an operator may view the status of an alternate mode for a predetermined length of time and then have the option of disposing the timepiece into that mode or returning the timepiece into the mode in which the timepiece was originally operating. It is further desirable to cause to be displayed on the timepiece display an instructional message indicating to the operator that continued actuation of said preselected actuator for a further predetermined period of time will cause the timepiece to be disposed into that alternate mode.

Accordingly, one object of the present invention is to provide an improved multimode electronic timepiece adapted to allow the timepiece operator to more readily dispose the timepiece into an alternate mode.

Another object of the present invention is to provide an improved multimode electronic timepiece with a program adapted to allow a timepiece operator, while in a home mode, to temporarily view the status of an alternate mode, and then either return to the home mode or dispose the timepiece into said alternate mode without cycling the timepiece through intervening modes.

A further object of the present invention is to provide an improved multimode electronic timepiece with a program adapted to provide the timepiece display with an instructional message indicating that the timepiece is about to be disposed into an alternate mode after the lapse of a predetermined time period.

SUMMARY OF THE INVENTION

Briefly stated, the invention comprises an improvement in a multimode electronic timepiece having a display, a plurality of manually actuated actuators and an integrated circuit programmed to keep time and to provide a plurality of modes, said integrated circuit being programmed to permit an operator to sequentially cycle said timepiece through said plurality of modes, including a home mode and an alternate mode, by selectively and repetitively actuating a first of said plurality of said actuators, wherein said improvement comprises:

mode selection means including a program for said integrated circuit responsive to selective actuation by said operator of a second of said plurality of actuators and adapted to temporarily display for a first predetermined time period the status of an alternate mode other than home mode, in order to avoid cycling said timepiece through intervening modes;

said program being adapted to display on said timepiece display an instructional message for a second predetermined period of time consecutive to said first predetermined period of time; said instructional message being displayed in response to continued actuation of said second actuator after the elapse of said first predetermined period of time;

said program being further adapted to return the timepiece to said home mode in response to the release of said second actuator before the elapse of said second predetermined period of time or to dispose the timepiece into said alternate mode in response to continued actuation of said second actuator after the elapse of said second predetermined period of time.

DRAWINGS

The subject matter which is regarded as the invention is particularly pointed out and distinctly claimed in the concluding portion of the specification. The invention, however, both as to organization and method of practice, together with further objects and advantages thereof, may best be understood by reference to the following description, taken in connection with the accompanying drawings, in which:

DESCRIPTION OF THE PREFERRED EMBODIMENT

Figure 1:
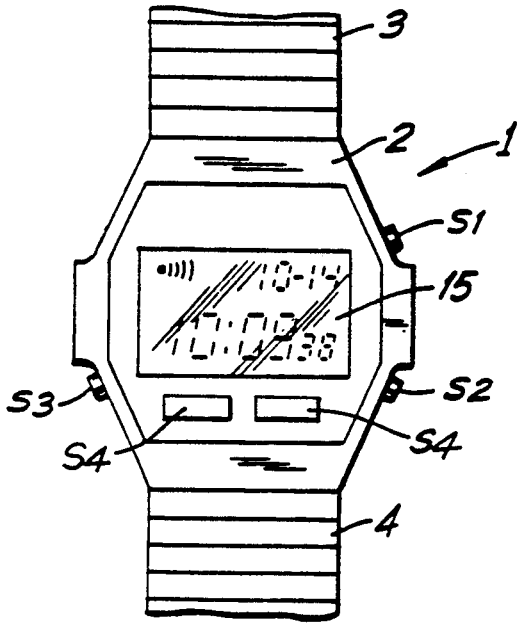
PRIOR ART FIG.1
FIG. 1 is a plan view of a multimode electronic wristwatch in simplified form.

Referring now to FIG. 1 of the drawing, a multimode electronic wristwatch 1 includes a case 2 adapted to be held on the wrist by a strap, portions of which are seen at 3 and 4. The wristwatch case includes 5 manual push button actuators S1, S2, S3, S4, and S5 arranged to close spring contacts (not shown), inside the watch case 2. An electrooptic display 15, which is commonly a liquid crystal display (or LCD) displays digits, letters or other symbols when activated by a microcomputer inside the watch in the form of an integrated circuit.

Figure 2:
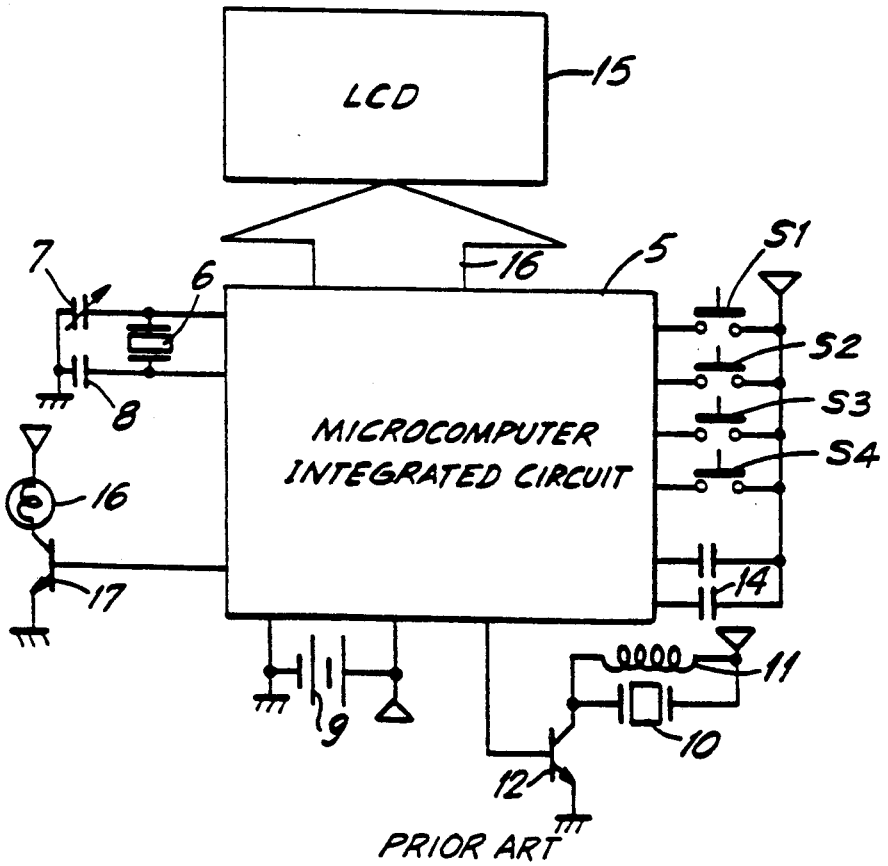
PRIOR ART FIG.2
FIG. 2 is a block diagram of a circuit for the wristwatch of FIG. 1, together with external components such as lamp, switches and display.

Referring now to FIG. 2 of the drawing, a schematic block diagram of the electrical connection is shown which is in accordance with conventional multimode electronic watch technology well known to those skilled in the art. A programmable microcomputer 5, in the form of a mask-programmable integrated circuit is bonded to a printed circuit board (not shown) and includes suitable pin connections and leads connected to various external components shown in the diagram which are also mounted on the printed circuit board. The microcomputer includes a microprocessor, operating system program for carrying out instructions, and memory locations. A quartz crystal 6 connected in circuit with capacitors 7 and 8 and connected to the oscillator pins of the integrated circuit 5 provide a high-frequency time base.

A battery power source 9 is provided in the form of a button type energy cell in the watch case. A watch alarm is made up of a piezoelectric crystal 10, inductance coil 11 and drive transistor 12. Two fixed external capacitors, 13,14 combined with other circuit elements combined inside the integrated circuit 5 serve to boost the output voltage to drive the LCD 15 through a display bus 16, which represents the several parallel leads connected to the various actuatable segments of the LCD display 15 (also shown in FIG. 1). Display 15 is arranged in close proximity with, so as to be illuminated by, a lamp 17 when the lamp is lit by a switching signal from integrated circuit 5 applied to the base of switching transistor 18.

Figure 3:
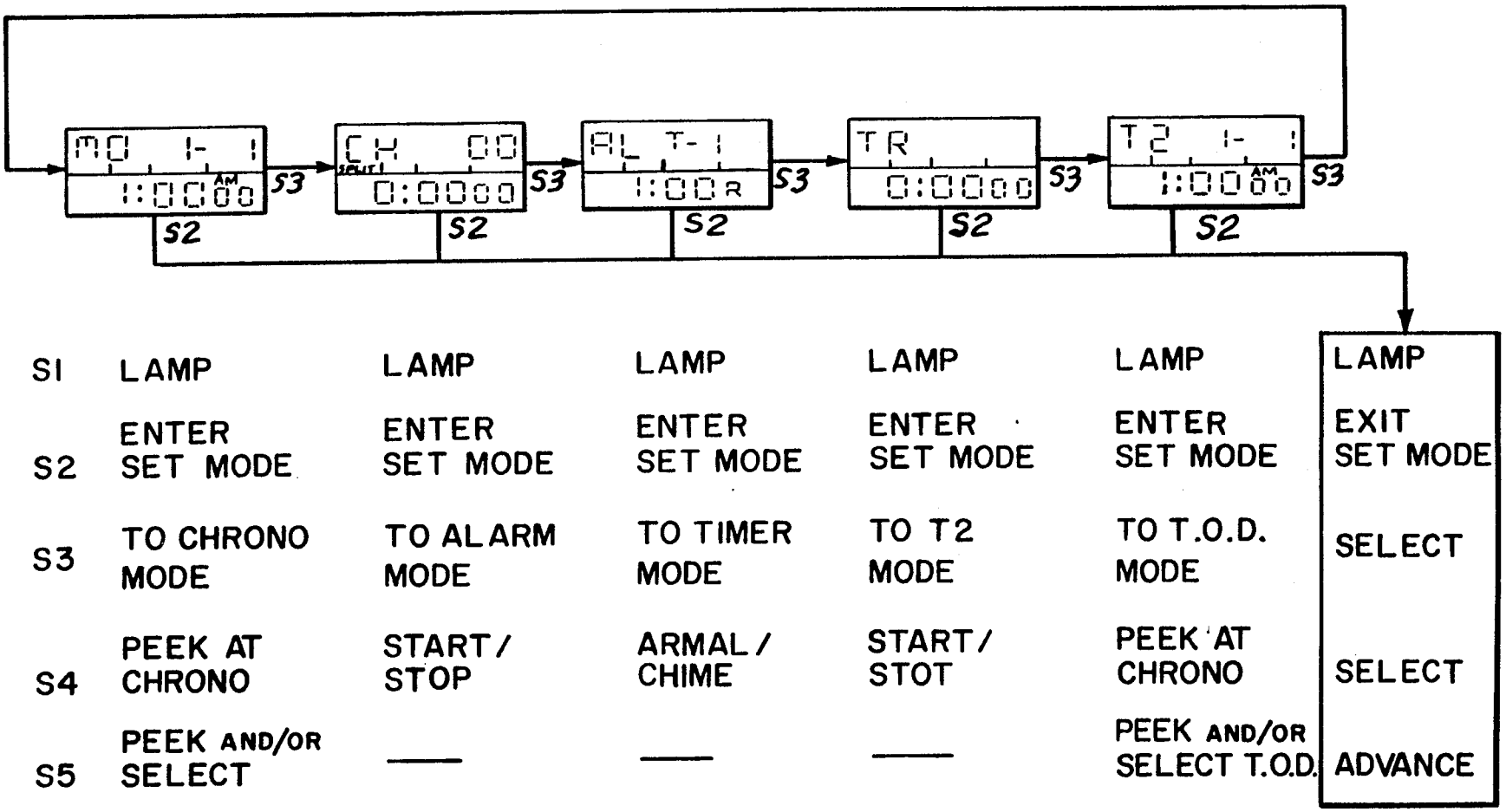
FIG. 3 is a block diagram of a multimode wristwatch illustrating a sequence of modes in response to manually actuated actuators.

Reference to FIG. 3 shows a block diagram of a multimode wristwatch and illustrates the sequence of modes in response to manually actuation switches S1–S5. Each of the blocks illustrates the initial appearance of the timepiece display at the moment the timepiece is first disposed into that particular mode. The modes for this particular timepiece are time-of-day, chronograph (CR), elapsed time (TR), alarm setting (AL), and alternate time zone (T2), although it will be understood that other modes may be substituted or added to said multimode wristwatch. As indicated in FIG. 3, the program is adapted such that repeated actuation of S3 sequentially cycles the timepiece through the aforementioned modes. Once the timepiece is disposed in one of the five modes, actuation of S2 initially initializes a subroutine SET for changing the information displayed, actuation of S3 or S4 selects the particular piece of information to be set (which is indicated on the display by "flashing" the indicia for that selected piece of information), actuation of S5 advances the said selected piece of information, and actuation of S1 cause the wristwatch lamp to be illuminated. Subsequent actuation of S2 while in the SET subroutine causes the timepiece to be disposed out of SET subroutine and returned to the home mode from which SET subroutine was entered.

In accordance with the present invention, actuation of S5 while the timepiece is disposed in the time-of-day mode will cause an alternate mode (T2 in FIG. 3) to be displayed temporarily. Continued uninterrupted actuation of S5 for a first and second predetermined period of time will cause the timepiece to be disposed into said alternate mode. A detailed explanation of the operation of this program will follow in the discussion accompanying FIG. 5.

Figure 4:
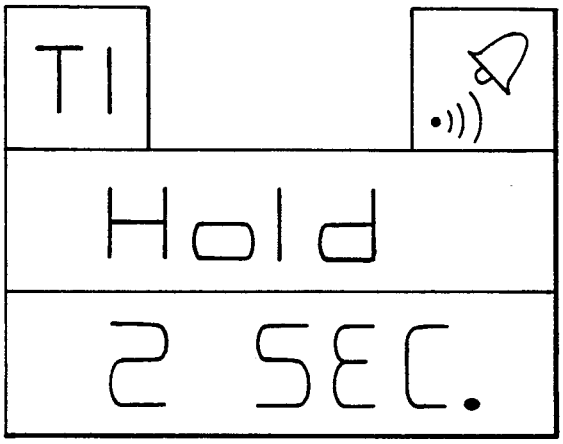
FIG. 4 is a block diagram of the instructional message that is displayed on the timepiece display.

Reference to FIG. 4 shows a block diagram of the instructional message that is displayed on the timepiece display immediately after the elapse of a first predetermined time period when the timepiece is disposed in time-of-day mode. In the preferred embodiment, said message comprises the combination of alphanumeric symbols, "Hold 2 SEC," said message being centrally provided on said timepiece display; "Hold" being centrally provided on the top half of said timepiece display and "2 SEC" being centrally provided on the bottom half of said timepiece display. (Where the timepiece is disposed in the alternate time zone mode "T1" will be replaced by "T2." (See FIG. 5)).

Figure 5:
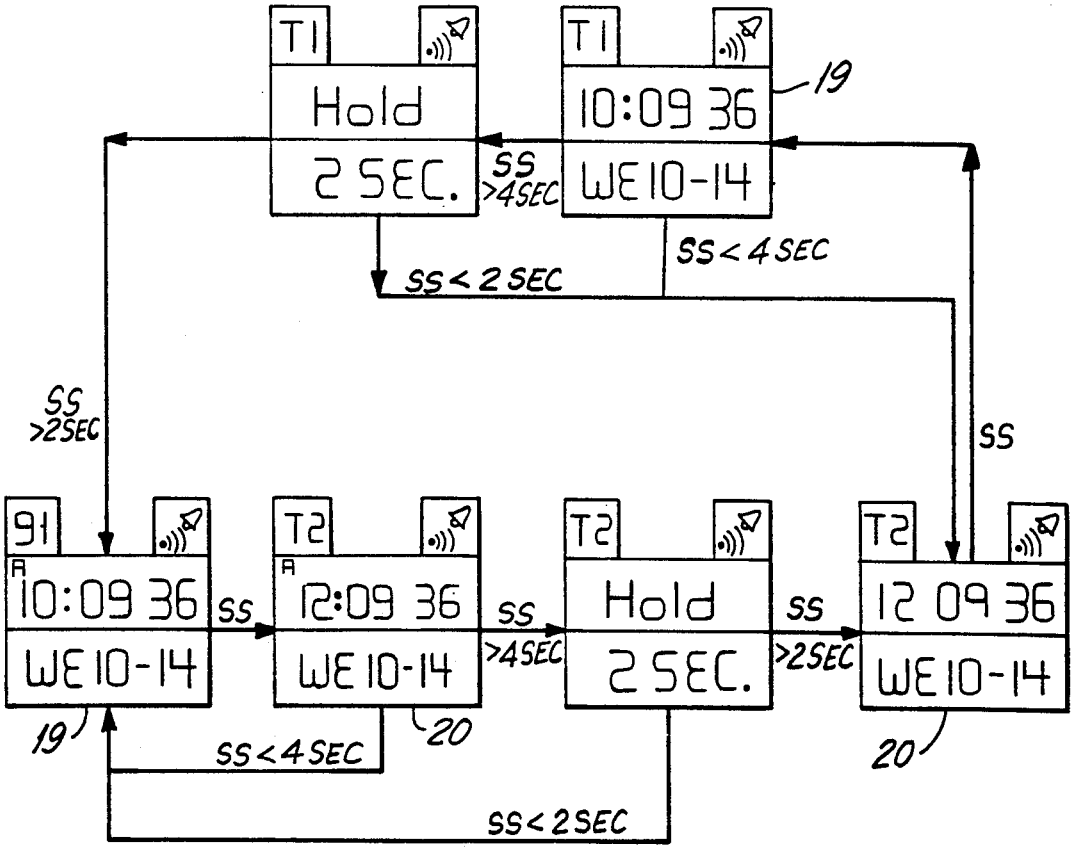
FIG. 5 is a detailed block diagram of the operation of the present invention.

Reference to FIG. 5 of the drawing illustrates more clearly the present invention. The first rectangle 19 represents a "home" mode showing time-of-day as 10:09.36 a.m. on Wednesday, October 14th. Actuation of S5 while the timepiece is disposed in this mode will caused to be displayed for a first predetermined period of time an alternate mode; in FIG. 5, an alternate time zone 20 (T2) which is two hours later on the same date, or 12:09.36 p.m. If S5 is released prior to the elapse of said first predetermined period of time, the timepiece will be returned to the time-of-day mode 19. However, if the operator continues to actuate S5 beyond this first predetermined period of time, said timepiece display will be caused to immediately display for a second predetermined period of time (two seconds in the preferred embodiment) a message indicating to the operator that continued actuation of S5 will cause the timepiece to be disposed into the alternate time zone mode 20. (See FIG. 4).

If the operator releases S5 before the elapse of said second predetermined period of time, the timepiece will be returned to the time-of-day mode 19. Continued actuation of S5 beyond said second predetermined period of time, however, will cause the timepiece to be disposed in said predetermined alternate time zone mode 20.

In the preferred embodiment, said "home" mode and said alternate mode alternately comprise time-of-day mode and alternate time zone mode (T2); said first predetermined period of time comprises four seconds; and said second predetermined period of time comprises two seconds.

However, while a multimode timepiece with a "home" mode and an alternate mode alternately comprising time-of-day mode and alternate time zone mode, has been described in order to illustrate the principle of the invention, it will be understood that the invention is applicable to any two modes of a multimode timepiece.

The term "mode" is used herein to designate the basic operating modes of a multimode electronic timepiece.

The term "home mode" is used herein to designate the basic operating mode in which the timepiece is ordinarily disposed.

The term "state" is used herein to designate the various functions that the timepiece's operating program is adapted to perform while disposed in a particular mode and any coincidental display of that function's value on the timepiece's electrooptic display 15.

While there has been described what is considered to be the preferred embodiment of the invention, other modifications will become known to those skilled in the art, and it is desired to cover, in the appended claims, all such modifications as fall within the true spirit of the scope of the invention.

What is claimed is:

1. Improvement in a multimode electronic timepiece having a display, a plurality of manually actuated actuators and an integrated circuit programmed to keep time and to provide a plurality of modes, said integrated circuit being programmed to permit an operator to sequentially cycle said timepiece through said plurality of modes, including a home mode and an alternate mode, by selectively and repetitively actuating a first of said plurality of said actuators, wherein said improvement comprises:

mode selection means including a program for said integrated circuit responsive to selective actuation by said operator of a second of said plurality of actuators and adapted to temporarily display for a first predetermined time period the status of an alternate mode other than home mode, in order to avoid cycling said timepiece through intervening modes;

said program being adapted to display on said timepiece display an instructional message for a second predetermined period of time consecutive to said first predetermined period of time; said instructional message being displayed in response to continued actuation of said second actuator after the elapse of said first predetermined period of time;

said program being further adapted to return the timepiece to said home mode in response to the release of said second actuator before the elapse of said second predetermined period of time or to dispose the timepiece into said alternate mode in response to continued actuation of said second actuator after the elapse of said second predetermined period of time.

2. The improvement according to claim 1, wherein the first predetermined time period is a loner interval and the second predetermined time interval is a shorter interval.

3. The improvement according to claim 1, wherein said instructional message on said timepiece display comprises words giving the length of said second predetermined period of time.

4. The improvement according to claim 1, wherein said home mode is time-of-day and wherein said alternate mode is an alternate time zone.

5. The improvement according to claim 1, wherein said home mode is an alternate time zone and wherein said alternate mode is time-of-day.

6. The improvement according to claim 1, wherein said home mode is an alarm setting mode and said alternate mode is any other mode of said timepiece.

7. The improvement according to claim 1, wherein said home mode is a chronograph mode and said alternate mode is any other mode of said timepiece.

8. The improvement according to claim 1, wherein said home mode is a timer mode and said alternate mode is any other mode of said timepiece.

* * * * *